US007014352B2

(12) United States Patent
Wu

(10) Patent No.: US 7,014,352 B2
(45) Date of Patent: Mar. 21, 2006

(54) ENDURABLE DECORATION LIGHT STRING

(76) Inventor: Jeng-Shyong Wu, No. 14, Alley 1, Lane 326, Shyr-Piin Road, Hsin-Chu City (TW)

( * ) Notice: Subject to any disclaimer, the term of this patent is extended or adjusted under 35 U.S.C. 154(b) by 77 days.

(21) Appl. No.: 10/694,673

(22) Filed: Oct. 28, 2003

(65) Prior Publication Data

US 2004/0208002 A1 Oct. 21, 2004

(30) Foreign Application Priority Data

Apr. 18, 2003 (CN) ..... 03238468 U

(51) Int. Cl.
*H01R 33/00* (2006.01)

(52) U.S. Cl. ..... 362/653; 362/654; 362/252

(58) Field of Classification Search ..... 362/227, 362/249, 252, 806, 653–654
See application file for complete search history.

(56) References Cited

U.S. PATENT DOCUMENTS 4,335,422 A * 6/1982 Van Ess ..... 362/388
5,288,047 A * 2/1994 Pan ..... 248/229.26
5,410,460 A * 4/1995 Liou ..... 362/250
5,601,361 A * 2/1997 Lawrence ..... 362/238
5,676,250 A * 10/1997 Walters ..... 206/419
5,934,793 A * 8/1999 Rahman ..... 362/249
5,944,408 A * 8/1999 Tong et al. ..... 362/252
6,126,298 A * 10/2000 Wu ..... 362/252
6,149,284 A * 11/2000 Wang ..... 362/249
6,184,629 B1 * 2/2001 Won ..... 315/185 S
6,217,193 B1 * 4/2001 Won ..... 362/249
6,260,987 B1 * 7/2001 Wu ..... 362/252
6,302,562 B1 * 10/2001 Wu ..... 362/252
6,390,645 B1 * 5/2002 Wu ..... 362/252
6,494,592 B1 * 12/2002 Rahman ..... 362/249
6,657,398 B1 * 12/2003 Chang ..... 315/185 S

* cited by examiner

*Primary Examiner*—Stephen Husar
*Assistant Examiner*—Jason Han
(74) *Attorney, Agent, or Firm*—McGlew and Tuttle, P.C.

(57) ABSTRACT

The present invention relates to an endurable decoration light string of light strings and one or more non-electrical connector. The light string includes mutually connective luminaries and electrical connector, in which the luminaries are composed of luminescent elements including lamp bulb, tungsten lamp, LED and lamp holder. Electrical conductor can be single or multiple wires, and uses the non-electrical connector parallel or by winding to fix on the predetermined fixed position of the head and tail ends and center part of the decoration light string, to tie a knot on the predetermined fixed position to enhance endurable strengthen of decoration light string. Thus, during the arrangement, the draw force of the decoration light string will be firstly supported by non-electrical connector to avoid the damage on the decoration light string and increase the life span on the decoration light string.

17 Claims, 6 Drawing Sheets

ENDURABLE DECORATION LIGHT STRING

FIELD OF THE INVENTION

The present invention relates to an endurable decoration light string. Especially, the present invention relates to a kind of design to provide an improved endurance of the decoration light string.

BACKGROUND OF THE INVENTION

When used, the present invention is able to provide decoration light string on both the head and tail ends and central parts to disallow getting loose and to ensure the stabilization of the transmission power as well as to increase the life span on the new design of the decoration light string.

Decoration light strings are commonly used in the soirée and celebration occasions. The great joyous feeling or atmosphere can be relied upon on various decoration light strings to embellish the conference hall. Commonly known decoration light string no matter single or multiple wires in traditional style to arrange the conference hall or by using latest network lighting style to arrange the hall, they all have some parts which are not contacted well in many decoration light strings. This is especially true and commonly seen on both head and tail ends.

The main reason of such formation is the carelessness to pull and drag during the installing of the light string. Even through this will not affect the whole decoration light string to start, however, the vision result will be affected more or less so that it is unfortunately beautiful and yet incomplete.

SUMMARY OF THE INVENTION

The purpose of the present invention is to provide an endurable decoration light string, and said light string is fixed on the predetermined fixed position of both the head and the tail ends and the central parts. The appropriate equipment can be installed to resist the draw force so as to increase the life span of the decoration light string.

A further purpose of present invention is to provide an endurable decoration light string by means of a non-electrical connector so that the draw force of the decoration light string will be firstly supported by non-electrical connector to avoid the damage on the decoration light string whereby to increase life time on the decoration light string. Further, the strength of the draw force of the non-electrical connector is greater than that of single or multiple electrical conductors and the rate of extension is small than that of electrical conductor.

The present invention of the endurable decoration light string is including: luminaries and electrical conductor, winding with parallel, series or series and parallel connection. The characteristic is to use non-electrical connector parallel or winding to fix on the predetermined fixed position of both head and tail ends and center part of the decoration light string. To tie a knot on the predetermined fixed position to enhance endurable strengthen of decoration light string. Further, the winding of the decoration light string and the non-electrical connector is able to use non-electrical connector as an axis to wind the decoration light string.

According to the characteristic mentioned above, the strength of draw force of non-electrical connector is greater than one or more electrical connector. Further, the predetermined fixed position can be on the long trunk or separate area in the position of electrical conductor of on luminaries.

However, the non-electrical connector can be composed of single wire, multiple wires or several connectors. When the non-electrical connector is composed of multiple wires and winding with several decoration light strings, the non-electrical connector and every decoration light string are to form round, triangle, rhombus, and square shape or predetermined pictures or words to make the luminaries on the electrical conductor becoming similar body shape surrounding.

Further, in the present invention of endurable decoration light string, another characteristic is that when the multiple electrical conductors separate out to connect with the luminaries, the multiple electrical conductors on one side of long trunk can be a curve. Therefore, after tying a knot firmly with non-electrical connector, a buffering function is obtained. The electrical conductor will not be affected if the draw force is formed and the non-electrical connector will take the force instead of the electrical conductors.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
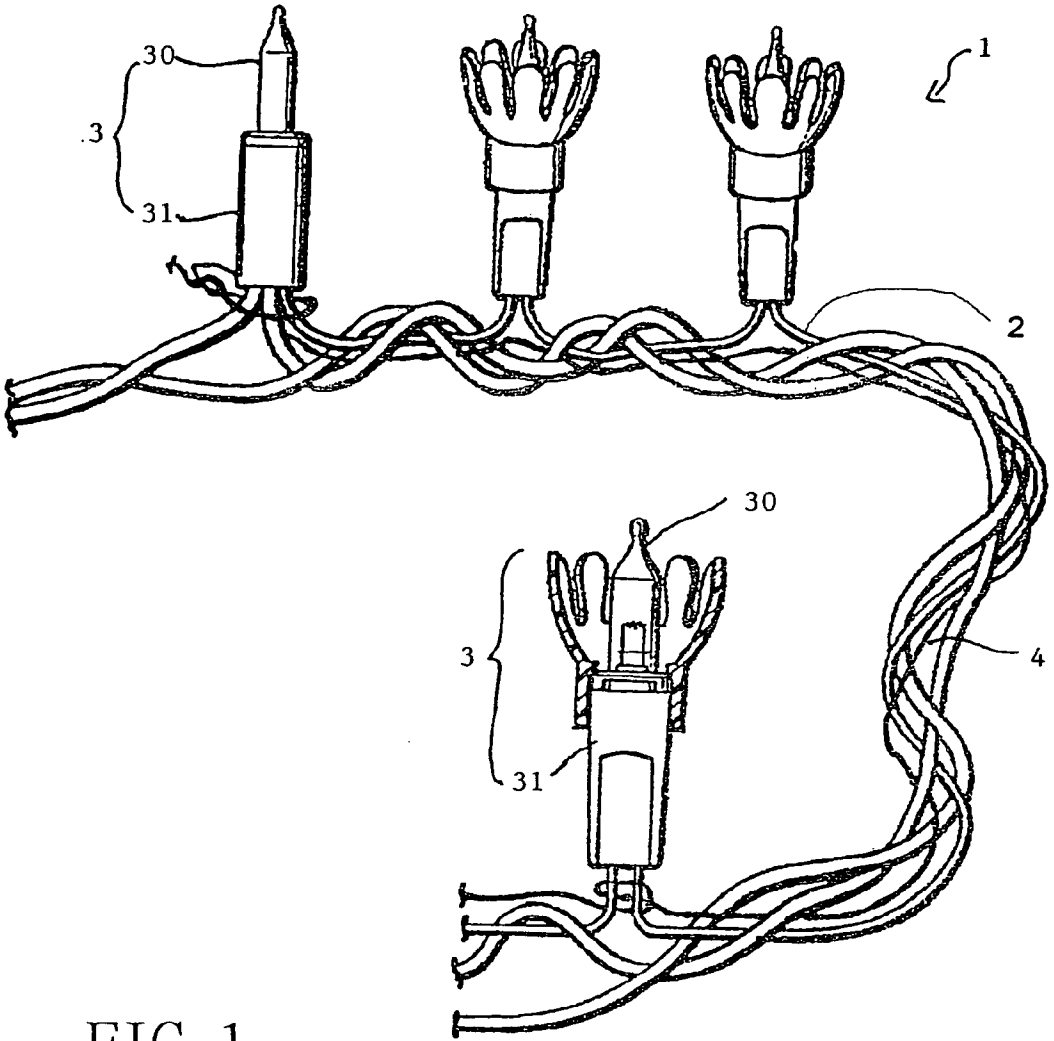
FIGS. 1 and 2 are perspective views showing the example of non-electrical connector to tie a knot on electrical conductor and luminaries in endurable decoration light string of the present invention.

Now referring to FIG. 1, an endurable decoration light string 1 of the present invention includes: electrical conductor 2, luminary 3 and non-electrical connector 4, in which, the electrical conductor 2 is of a predetermined length. In this drawing, a small section is illustrated for description purpose. Each of luminaries 3 connected on electrical conductor 2 is composed of lamp bulb 30 and lamp holder 31. Further, along with electrical conductor 2, the non-electrical connector 4 is parallel and winding with the electrical conductor 2, also fixing a knot on the long trunk of the electrical conductor 2. Thus, the strength of draw force of the decoration light string 1 can be enhanced.

Figure 2:
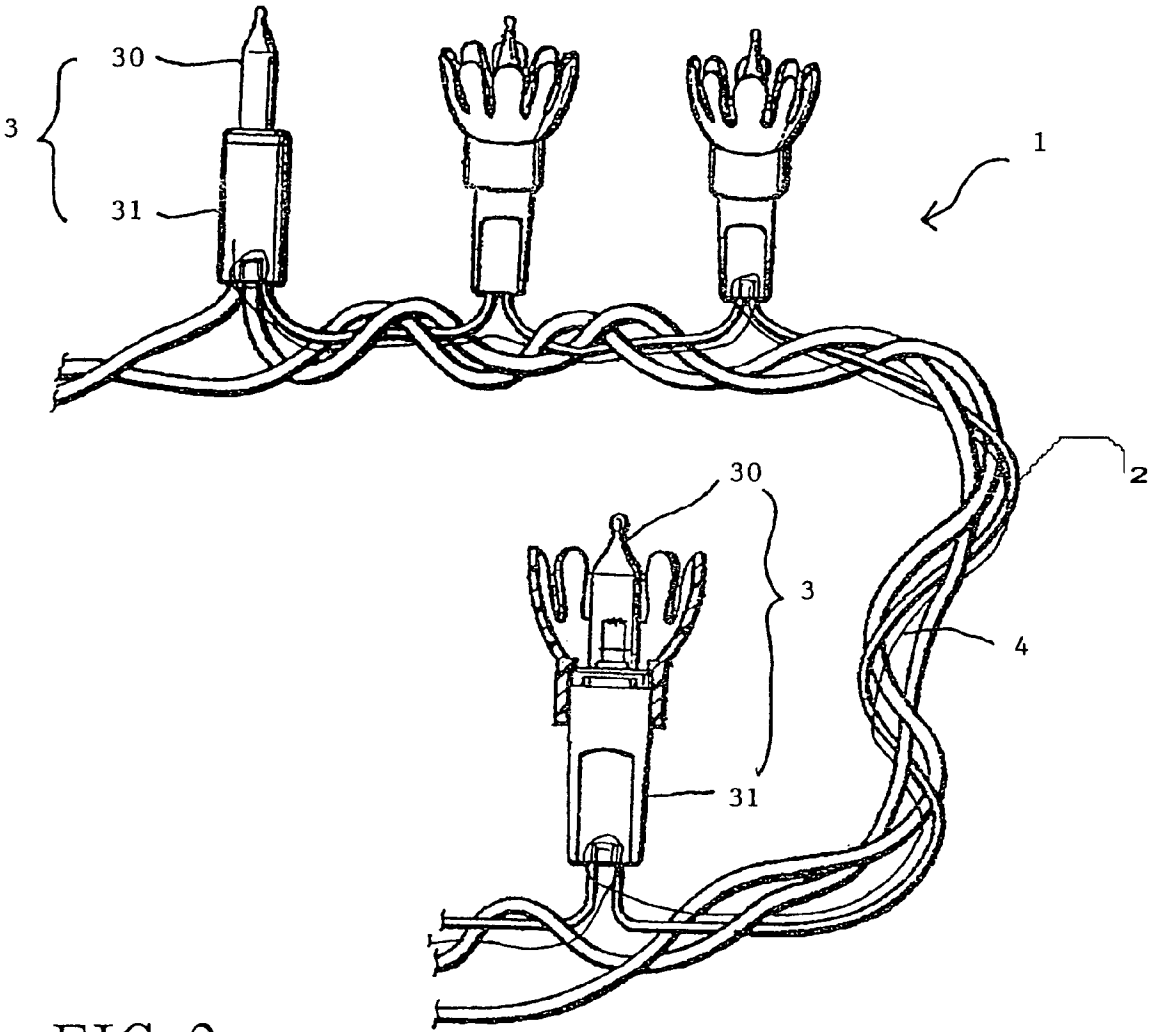

Similarly, FIG. 2 (also showing a small section of the decoration light string 1) is showing that one non-electrical connector 4 is used in parallel winding, and make a knot on luminary 3 so that the strength of draw force of decoration light string 1 can be enhanced.

Figure 3:
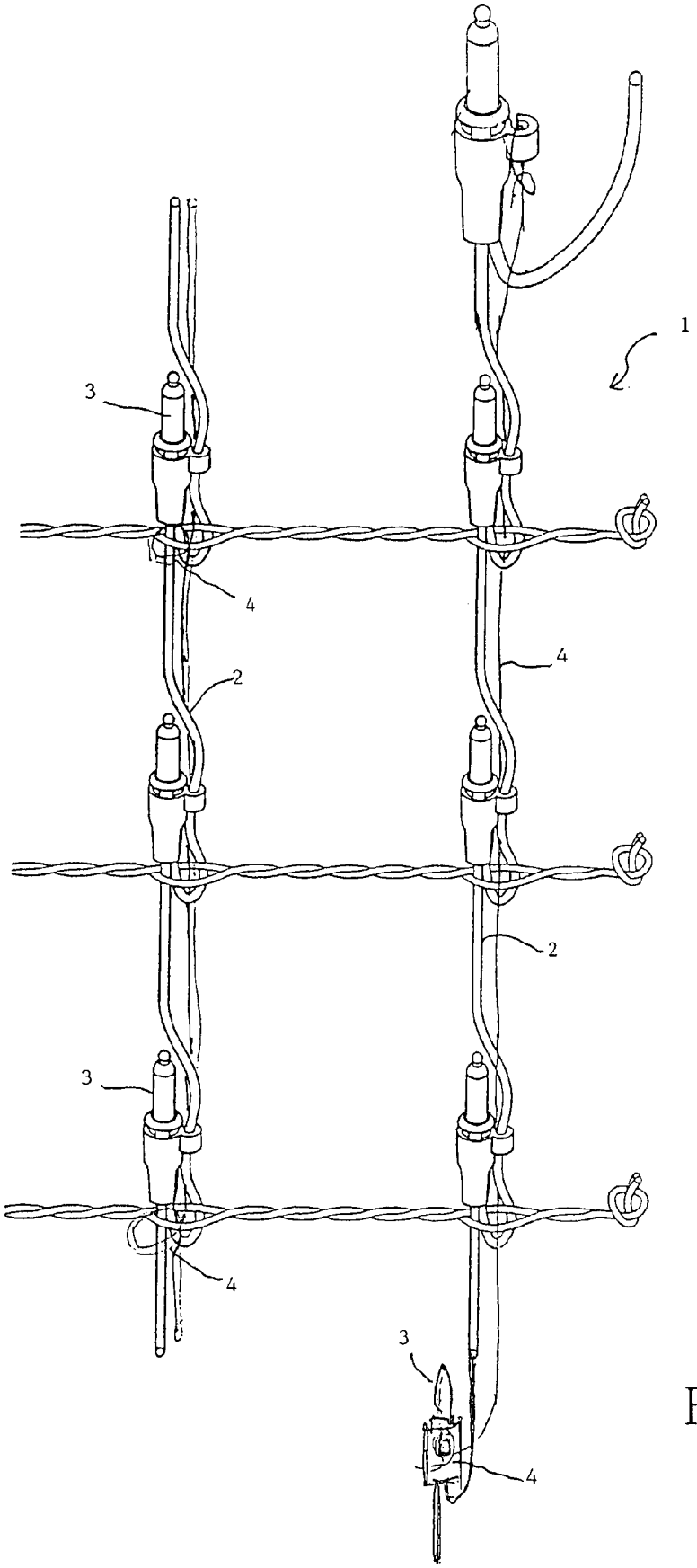
FIGS. 3 and 4 are perspective views showing the example on the network shape of the single and twin wires non-electrical connector to tie the knots respectively in decoration light string of the present invention.

Also, referring to FIG. 3, it is the network shape of the decoration light string 1. For the convenience of understanding, it is a perspective view of a small section for description purpose. It is composed of many electrical conductors 2, luminaries 3 and non-electrical connector 4 by means of parallel series interconnected into one unit. Further, every electrical conductor 2 located on a side of the long trunk becomes a curve shape to serve as a buffering function after taking a knot firmly with the non-electrical connector 4. However, on a few predetermined fixed positions, non-electrical connector 4 is used to wind and take a knot. The left side on the drawing is fixing a knot on the electrical conductor 2 of long trunk, and then the right side fixes a knot on luminary 3.

Therefore, when the draw force is applied to the light string, the non-electrical connector 4 is able to support it, and such draw force will not affect the electrical conductor 2.

Figure 4:
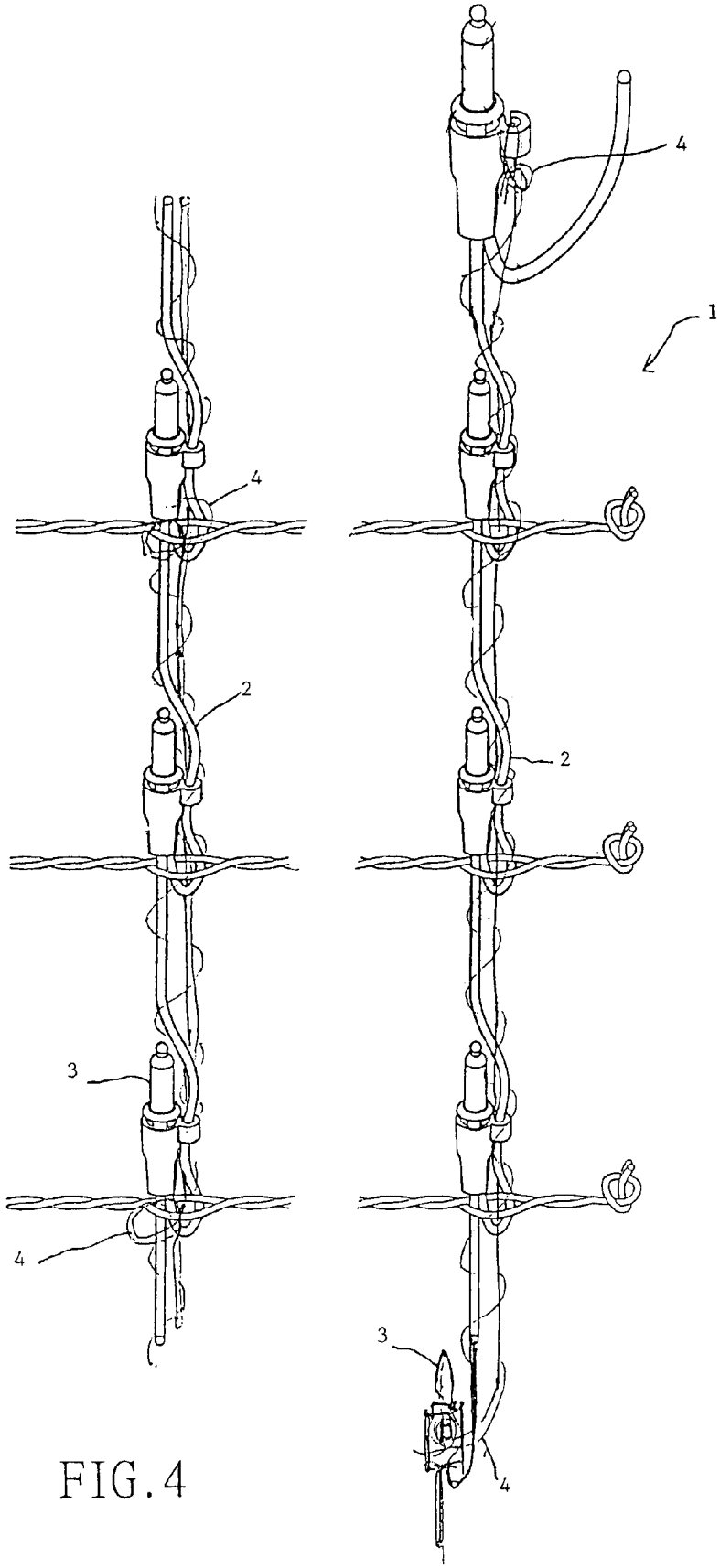

Similarly, FIG. 4 is network shape view of the decoration light string 1, in which two non-electrical connectors 4 are used to tie a knot with electrical conductor 2 of long trunk.

Figure 5:
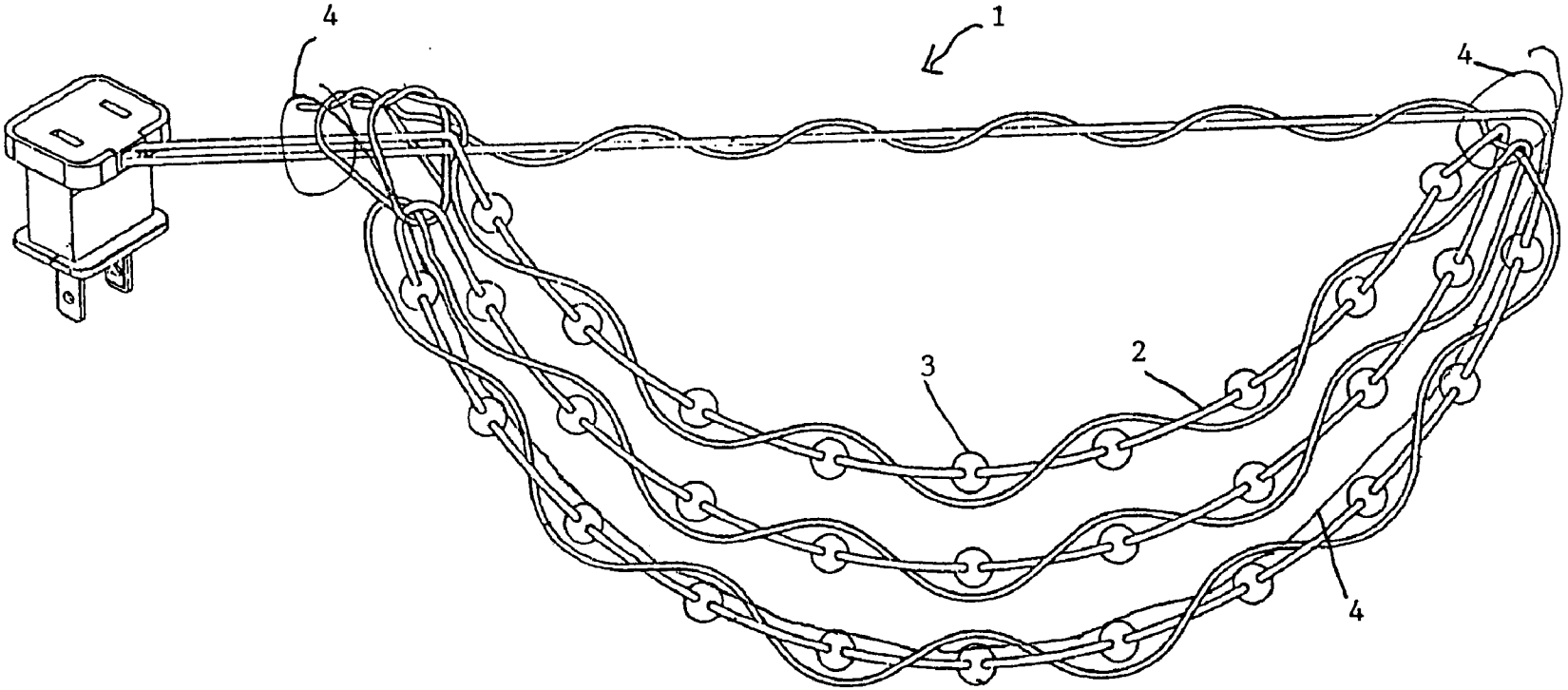
FIG. 5 is a perspective view showing the example on ring shape of the single and twin wires of the non-electrical connector to tie the knots respectively in decoration light string of the present invention.

FIG. 5 is a ring shape type of decoration light string 1. Above the ring shape type of light string, many electrical conductors 2, luminaries 3 and non-electrical connector 4 are provided by means of series to interconnect into one unit. Using non-electrical connector 4 to wind with electrical conductor 2, the knots are taken on both the head and the tail ends of electrical conductor 2. Therefore, when the draw force is occurred, the non-electrical connector 4 is able to support it, and such draw force will not affect the electrical conductor 2.

Figure 6:
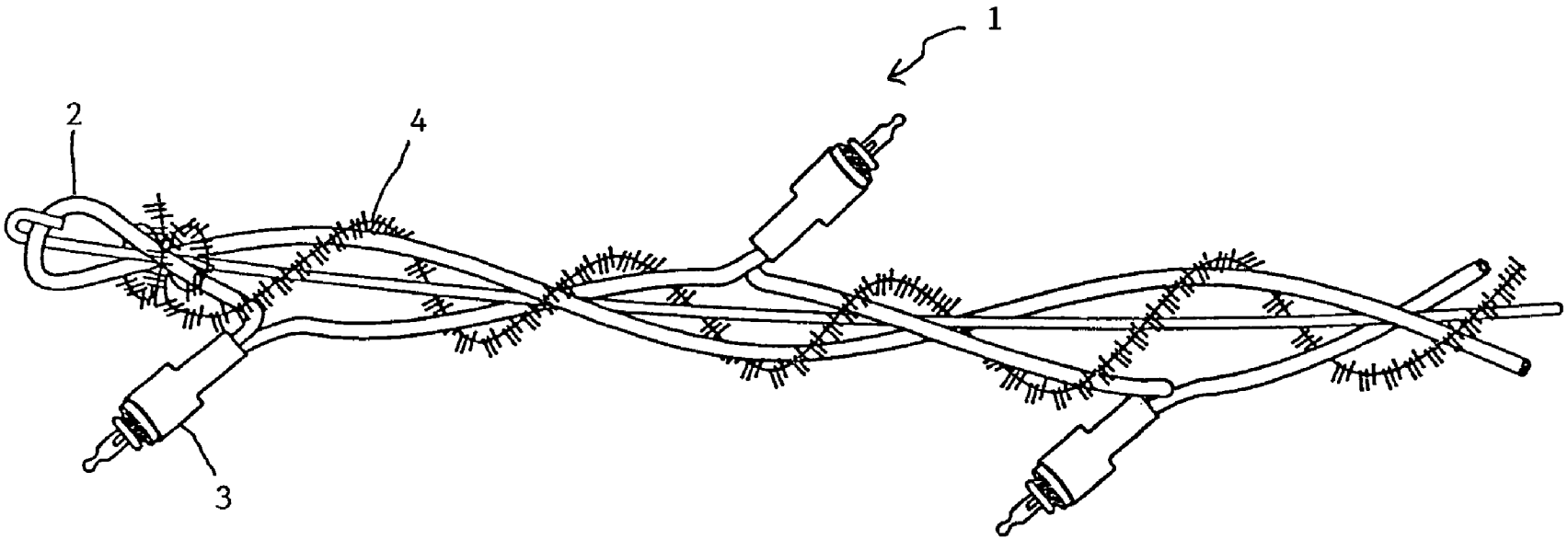
FIG. 6 is a perspective view showing the example of on non-electrical connector attached leaf shape of decorating article in the endurable decoration light string of the present invention.

Referring to FIG. 6, it is similar to the endurable decoration light string 1 shown in FIG. 1 with only attached leaf shape of decorating articles on non-electrical connector 4. This can enhance the beauty of decoration light string. Also, one end is showing a long trunk to become a curve shape on the electrical conductor 2. Therefore, it has a buffering function when the non-electrical conductor 4 is knotted.

The features and preferred embodiments of the present invention have been described in the foregoing specification. The invention intended to be protected herein, however, is not to be construed as limited to the particular forms disclosed. Variations and changes, which maybe made by those skilled in the art, are with out departing form the scope of the present invention.

What is claimed is:

1. An endurable decoration light string comprising:

a set of light strings; and one or more non-electrical connector, wherein said light string includes a set of mutually connective luminaries and an electrical conductor, said electrical conductor being single or multiple wires, and said endurable decoration light string includes said non-electrical connector extending substantially parallel or winding with said electrical conductor to fix a portion of said non-electrical connector on a predetermined fixed position on each of a head end, a tail end and a center part of the decoration light string, by said non-electrical connector tying a knot on said predetermined fixed position to enhance endurable strengthening of the decoration light string, wherein the resistance strength to the draw force of said non-electrical connector is greater than that of said electrical conductor and the rate of extension of said non-electrical connector is smaller than that of said electrical conductor.

2. An endurable decoration light string as claimed in claim 1, wherein the length of said electrical conductor is longer than the length of said non-electrical connector in between two or more than two predetermined fixed positions.

3. An endurable decoration light string as claimed in claim 1, wherein said non-electrical connector extends parallel and winds with said electrical conductor between the predetermined fixed positions.

4. An endurable decoration light string as claimed in claim 1, wherein said predetermined fixed position is defined as being on a long trunk or in a separate area along said electrical conductor or on said luminaries.

5. An endurable decoration light string as claimed in claim 1, wherein the winding of the decoration light string with said non-electrical connector uses said non-electrical connector as an axis to wind the decoration light string.

6. An endurable decoration light string as claimed in claim 1, wherein said electrical conductor to be separated out to connect with said luminaries, said electrical conductor on one side of a long trunk being a curve, whereby said knot is firmly connected to said non-electrical connector such that a buffering function is obtained, said electrical conductor not affected while the draw force is formed and said non-electrical connector capable of taking the force.

7. An endurable decoration light string as claimed in claim 1, wherein said non-electrical connector is composed of single wire, multiple wires or several connectors.

8. An endurable decoration light string as claimed in claim 1, wherein said non-electrical connector is attached to decorative articles, such as leaf or designed pattern.

9. An endurable decoration light string as claimed in claim 1, wherein said non-electrical connector is composed of multiple wires and winds with several decoration light strings, wherein said non-electrical connector and said decoration light strings form round, triangle, rhombus, and square shape or predetermined pictures or words to make said luminaries on said electrical conductor form similar body contour shape of said round, triable, rhombus, and square shape or predetermined pictures or words.

10. An endurable decoration light string as claimed in claim 1, wherein said luminaries and said electrical conductor are connected in series, parallel or series-parallel.

11. An endurable decoration light string as claimed in claim 1, wherein said luminaries are composed of luminary components such as: lamp bulb, tungsten lamp, LED and lamp holder or lamp base.

12. An endurable decoration light string comprising:

a set of light strings; and one or more non-electrical connector, wherein said light strings include a set of mutually connective luminaries along an electrical conductor, said electrical conductor being single or multiple wires, and having non-electrical connector extending parallel or winding fixedly on a predetermined fixed position of both head and tail ends and center part of the decoration light string by tying a knot on said predetermined fixed position firmly, whereby the length of the decoration light string being longer than the length of said non-electrical connector such that a drawing force is resisted by said non-electrical connector to protect the endurable strength of the decoration light string.

13. An endurable decoration light string comprising:

a set of light strings; and one or more non-electrical connector, wherein said light strings include a set of mutually connective luminaries fixed along on an electrical conductor, said electrical conductor being a single wire and having non-electrical connector extending parallel or winding fixedly on a predetermined fixed position of both head and tail ends and center part of the decoration light string, by tying a knot on said predetermined fixed position firmly, the decoration light string and non-electrical connector being substantially parallel or winding along said electrical conductor and fixed on said predetermined fixed position to enhance endurable strengthening of the decoration light string, wherein the resistance strength to the draw force of said non-electrical connector is greater than that of said electrical conductor and the total length of said non-electrical connector is shorter than that of said electrical conductor.

14. An endurable decoration light string comprising:

an electrical conductor of single or multiple wires, in a series network;

a head luminary provided proximate to an end of said series network;

a tail luminary provided proximate to another end of said series network;

an intermediate luminary located between said head luminary and said tail luminary in part of said series network, wherein each said luminary includes a holder, a lamp bulb fixed in said holder, an electrical conductor input portion of said electrical conductor leading into and proximate to said holder, an electrical output portion of said electrical conductor leading out of and proximate to said holder, and said input portion and said output portion define a predetermined fixed position;

a non-electrical connector extending substantially parallel to said electrical conductor, said non-electrical connector having a securing means provided at each of said head luminary, said tail luminary and said intermediate luminary and positioned at least at a location of inside said holder and by a knot around said predetermined fixed position, said non-electrical connector having a tensioned means by a knot to counter a drawing force on said series network.

15. An endurable decoration light string according to claim 14, wherein the length of said electrical conductor between two said predetermined fixed positions is longer than the length of said non-electrical connector.

16. An endurable decoration light string according to claim 14, wherein the resistance strength to the draw force of said non-electrical connector is greater than that of said electrical conductor and the rate of extension of said non-electrical connector is smaller than that of said electrical conductor.

17. An endurable decoration light string according to claim 14, wherein the length of said non-electrical connector is shorter than the length of said electrical conductor, and resistance strength to the draw force of said non-electrical connector is greater than the resistance strength of said electrical conductor and the rate of expansion of said non-electrical connector is smaller than the rate of expansion of said electrical conductor between two said predetermined fixed positions.

* * * * *